US008268263B2

(12) United States Patent
Campbell et al.

(10) Patent No.: US 8,268,263 B2
(45) Date of Patent: Sep. 18, 2012

(54) REAGENT CARTRIDGE

(75) Inventors: Adrian M. Campbell, Stamford, CT (US); Nicolae Dumitrescu, Stamford, CT (US)

(73) Assignee: Siemens Healthcare Diagnostics Inc., Tarrytown, NY (US)

( * ) Notice: Subject to any disclaimer, the term of this patent is extended or adjusted under 35 U.S.C. 154(b) by 192 days.

(21) Appl. No.: 12/675,818

(22) PCT Filed: Aug. 27, 2008

(86) PCT No.: PCT/US2008/074360

§ 371 (c)(1), (2), (4) Date: Mar. 1, 2010

(87) PCT Pub. No.: WO2009/032645

PCT Pub. Date: Mar. 12, 2009

(65) Prior Publication Data

US 2010/0310426 A1 Dec. 9, 2010

Related U.S. Application Data

(60) Provisional application No. 60/970,335, filed on Sep. 6, 2007.

(51) Int. Cl.

| | |
|---|---|
| ***B01L 3/00*** | (2006.01) |
| ***B01L 3/02*** | (2006.01) |
| ***B65B 1/04*** | (2006.01) |
| ***B65B 3/04*** | (2006.01) |
| ***B67C 3/00*** | (2006.01) |

(52) U.S. Cl. ..... 422/512; 422/501; 422/516; 141/329; 141/330

(58) Field of Classification Search ..... 141/329–330; 422/512, 516

See application file for complete search history.

(56) References Cited

U.S. PATENT DOCUMENTS

| | | | | |
|---|---|---|---|---|
| 3,557,787 | A * | 1/1971 | Cohen | 604/90 |
| 4,303,069 | A * | 12/1981 | Cohen | 604/201 |
| 5,286,453 | A * | 2/1994 | Pope | 422/512 |
| 6,558,632 | B1 | 5/2003 | Guller et al. | |
| 7,250,303 | B2 | 7/2007 | Jakubowicz et al. | |
| 7,703,486 | B2 * | 4/2010 | Costanzo | 141/346 |
| 2002/0090736 | A1 | 7/2002 | Ulin | |
| 2002/0189712 | A1 * | 12/2002 | Safabash | 141/329 |
| 2004/0170533 | A1 | 9/2004 | Chu | |
| 2005/0031493 | A1 | 2/2005 | Kipke et al. | |
| 2006/0178644 | A1 * | 8/2006 | Reynolds | 604/232 |
| 2007/0048194 | A1 | 3/2007 | Schulein et al. | |

FOREIGN PATENT DOCUMENTS

| | | |
|---|---|---|
| WO | 9603224 | 2/1996 |
| WO | 9603224 A1 | 2/1996 |
| WO | 96/28205 | 9/1996 |
| WO | 00/28940 | 5/2000 |

OTHER PUBLICATIONS

PCT International Search Report, ISA/US, Oct. 31, 2008.
International Search Report for Interntational Application PCT/US2008/74360.

* cited by examiner

*Primary Examiner* — Jill Warden
*Assistant Examiner* — Charles D Hammond

(57) ABSTRACT

A self dispensing reagent cartridge includes a vessel with a movable piston at one end and a puncturable self sealing septum at an opposite end. A hollow needle is located in alignment with the septum. The vessel is moved toward the needle to enable the needle to puncture the septum. The piston is then moved toward the septum to enable a predetermined amount of liquid in the vessel to be transferred outwardly of the vessel through the needle in an amount corresponding to the piston stroke.

10 Claims, 3 Drawing Sheets

REAGENT CARTRIDGE

FIELD OF THE INVENTION

This invention relates to devices and methods for removing liquid from a vessel in amounts that can be precisely controlled, especially liquids that are used in sample analysis of body fluids, including blood serum and urine. More specifically, the invention relates to a self-contained reagent fluid delivery system wherein liquid is expelled from a reagent container directly into a cuvette without separate aspiration and dispense probes.

BACKGROUND OF THE INVENTION

During laboratory analysis of body fluid such as blood, a supply of blood serum that is tested for a particular individual is usually contained in a single sample tube. The amount of blood serum in the sample tube is generally of sufficient quantity to allow for repeated aspirations of relatively small amounts of serum, wherein each aspiration is used for a specific test. Thus, a selected amount of sample is aspirated from the sample tube for each test and delivered to one or more processing stations in a sample analysis system.

Each specific, distinctive blood test on an aspirated sample can involve a chemical reaction with one or more reagents. The reactions provide data that forms the basis for sample analysis information that is ultimately furnished to a physician or patient.

An aspiration device such as a syringe or probe is commonly used to aspirate liquid, such as reagent, from a reagent container in predetermined controlled amounts. The aspiration device is also generally used to dispense the aspirated liquid into a reaction cuvette.

In some instances a single aspiration probe may be used to aspirate reagent from more than one container. In one known automated sample analysis system numerous tests are conducted in rapid sequence on blood serum from different individuals. Thus, if one aspiration device is used to aspirate and dispense reagent from more than one container in succession, there will be a residue of reagent from a first reagent container on the aspiration probe when the probe enters a second reagent container. Therefore, the residue of reagent from the first container that remains on the aspiration probe can be carried over to the second reagent container when an aspiration is made from the second reagent container, resulting in a phenomenon known as carryover.

The carryover of reagent from one container to another container adds extraneous material to the other container. Such extraneous or carryover material is undesirable because it can have an adverse effect on test accuracy and lead to erroneous analytical data during sample analysis. The risk of carryover is a deterrent to using the same aspiration probe for successive aspiration-dispense cycles.

One way of dealing with the carryover problem is to change the aspiration probe each time that reagent is aspirated from a container or other liquid holding vessel. The changing of probes every time an aspiration is performed can be an expensive and time-consuming process.

Another way of dealing with the carryover problem is to wash any residue off the probe after each aspiration, before introducing the same probe into another reagent container. The wash process is also time consuming and expensive.

U.S. Pat. No. 6,740,240 to Colville shows an apparatus for sampling and filtering fluid. A piercing device is used to pierce a container cap to enable relatively large quantities of liquid from the container to drain by gravity through the piercing device into a channel. The drained liquid in the channel is then filtered. Colville does not show or suggest how to control the liquid drainage from the container through the piercing device in relatively small precise amounts. Furthermore Colville does not show or suggest repetitive use of the piercing device to obtain numerous expulsions of small precise amounts of liquid from a container.

U.S. Pat. No. 6,471,069 to Lin shows a device for separating components of fluid sample by centrifugation. Lin uses a needle to infuse liquid into a container through a sealable septum. Lin does not show removal of precise amounts of liquid from a container.

It is thus desirable to transfer liquid in predetermined precise amounts from a container or other vessel using a self-contained system that does not include an aspiration and dispense probe.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
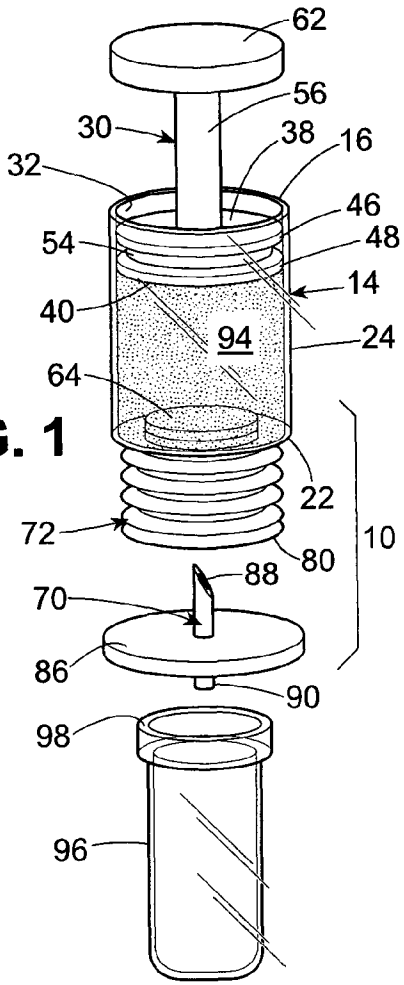
FIG. 1 is simplified partially exploded perspective view of a reagent cartridge system incorporating one embodiment of the invention.

Referring to the drawings, a reagent cartridge incorporating a preferred embodiment of the invention is generally indicated by the reference number 10 in FIG. 1.

The reagent cartridge 10 includes a generally cylindrical vessel member 14 having an upper end 16, a lower end 22 and a vessel wall 24 extending between the upper end 16 and the lower end 22.

A piston member 30 is provided at the upper end 16 of the vessel member 14 for movement within the vessel member 14 along an inner wall surface 32 of the vessel member 14.

The piston member 30 includes a piston head 38 having a compression surface 40. The piston head 38 is sized, relative to the inner wall surface 32 of the vessel 14, to establish a leak-tight seal between spaced peripheral edge portions 46 and 48 of the piston head and the vessel surface 32, while permitting relative movement between the piston head 38 and the vessel 14. If desired, a piston ring or an O-ring (not shown) can be provided in an annular space 54 of the piston head 38 between the peripheral edge portions 46 and 48 to establish a leak-tight seal between the piston head 38 and the inner surface 32 of the vessel 14.

The piston member 30 further includes a piston rod 56 having one end joined to the piston head 38 and an opposite end joined to an engagement disk 62 that is engagable with a moveable drive means (not shown) for movement of the piston downwardly or upwardly relative to the inner wall surface 32 of the vessel 14. The piston drive means can include a step-motor (not shown) that is selected to provide precise predetermined incremental movements of the piston head 38 in the vessel 14.

A self-sealing septum 64 is joined in leak tight relationship to the lower end 22 of the vessel member 14. The septum 64, which is of a known self-sealing construction, is puncturable by a hypodermic needle, such as the needle 70, and is self sealing when the needle 70 is withdrawn from the septum 64

Figure 3:
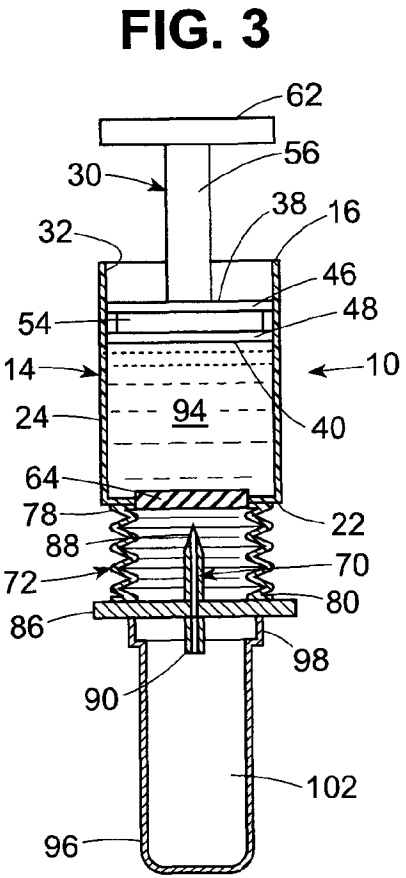
FIG. 3 is sectional view taken on the line 3-3 of FIG. 2.
Figure 6:
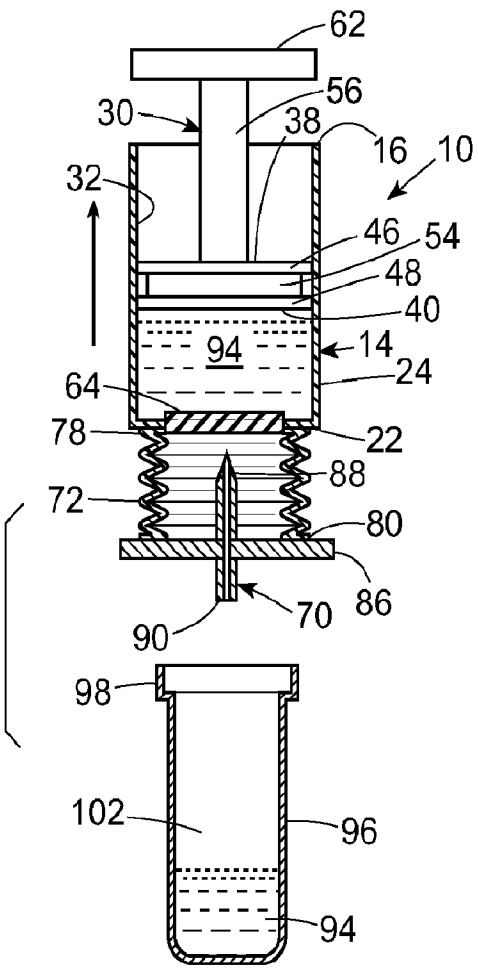

The reagent cartridge 10 further includes a flexible, collapsible neck-like member 72, preferably in the form of a bellows. The neck-like member 72 is in a normally expanded condition as shown in FIGS. 3 and 6 and has one end 78 joined to the lower end 22 of the vessel member 14 and/or the periphery of the septum 64 as shown in FIG. 3. In this manner, the bellows end 78 forms a leak-tight seal around the lower end 22 of the vessel member 14. An opposite end 80 (FIG. 3) of the bellows 72 is joined to a support flange 86 that supports the hypodermic needle 70 such that a puncturing end 88 of the needle 70 extends upwardly toward the septum 64 from the flange 86. Under this arrangement the puncturing end 88 of the needle 70 is confined within the neck-like number 72 when the needle 70 is in a non-puncturing position as shown in FIG. 3.

In using the reagent cartridge 10, a selected amount of reagent 94 can be provided in the vessel 14 through the lower end 22 before installation of the septum 64 at the lower end 22. The position of the piston 20, which corresponds to the liquid level in the vessel 14, following filling of the vessel 14 with the reagent 94, can be determined and recorded electronically in any suitable known manner to provide reference data corresponding to the initial piston position and the liquid level in the vessel 14.

Since the inside diameter of the vessel 14 is known and the displacement stroke of the piston 30 is measurable in a known manner, any incremental movement of the piston is correlatable with a corresponding volumetric displacement of reagent from the vessel 14.

Preferably the reagent cartridge 10 is located at a reagent transfer station (not shown) and a cuvette such as the cuvette 96 is transported to the reagent transfer station on a conveyer belt (not shown), for example. The cuvette 96 can thus be brought into alignment with the reagent cartridge 10, as shown in FIG. 1, and held in a fixed position during reagent transfer. Prior to the reagent transfer the aligned cuvette 96 is spaced below the reagent cartridge 10.

Figure 2:
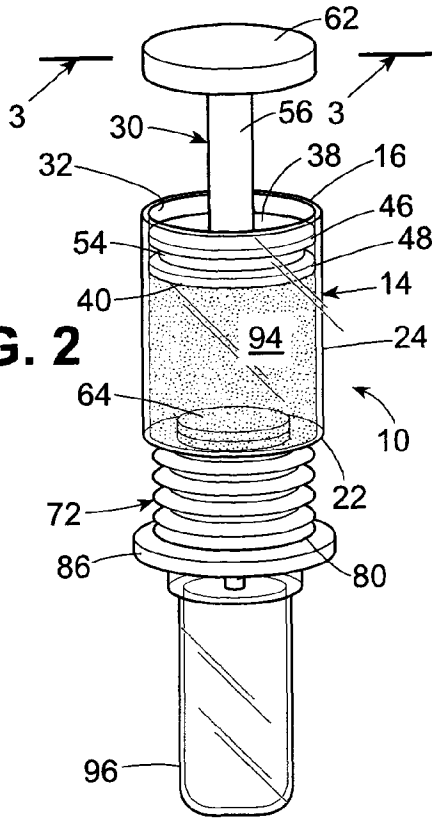
FIG. 2 is a simplified perspective view thereof wherein the reagent cartridge is positioned over a cuvette during transfer of liquid from the reagent cartridge to the cuvette.

The reagent cartridge 96 with the piston 30 can be moved downwardly (FIG. 3) toward the aligned cuvette 96 to enable the needle support flange 86 to initially engage an upper end 98 of the cuvette 96 as shown in FIGS. 2 and 3. During such initial engagement the neck-like member 72 is in its normally expanded condition. The outlet end 90 of the hypodermic needle 70 is thus confined in an inside space 102 of the cuvette 96, and the puncturing end 88 of the hypodermic needle 70 is directed toward the septum 64.

Figure 4:
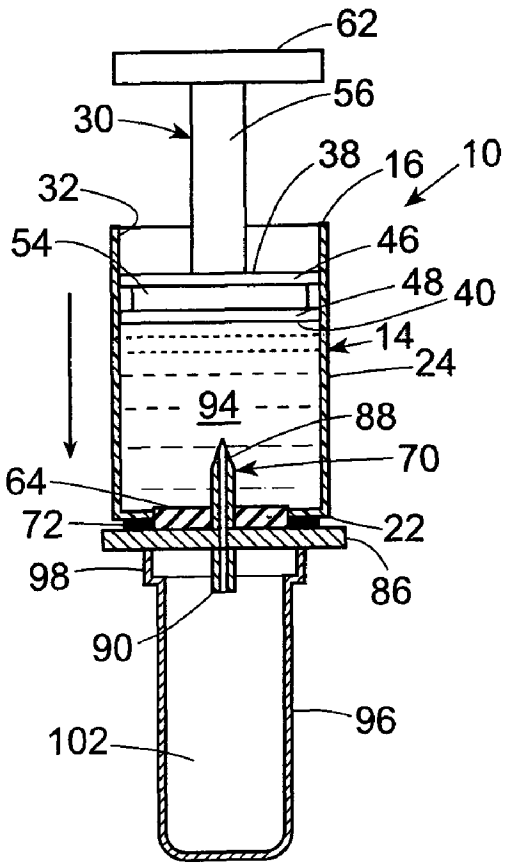

The reagent cartridge 10 and the piston 30 continue to move downwardly, from the initial engagement position of FIGS. 2 and 3 toward the fixed aligned cuvette 96, to a desired septum puncturing position such as shown in FIG. 4. Thus the downward movement of the reagent cartridge 10 and piston 30 causes the septum 64 to engage the puncturing end 88 of the hypodermic needle 70, and also causes the neck-like member 72 to compress or collapse from the normally expanded position of FIG. 3 to the compressed position of FIG. 4, wherein the flange 86 ceases further movement toward the lower end 22 of the vessel member 14.

The relative positions of the vessel 14, the piston 30, the hypodermic needle 70, the flange 86 and the cuvette 96 can be electronically recorded and stored in any suitable known manner using known computer programming techniques.

Figure 5:
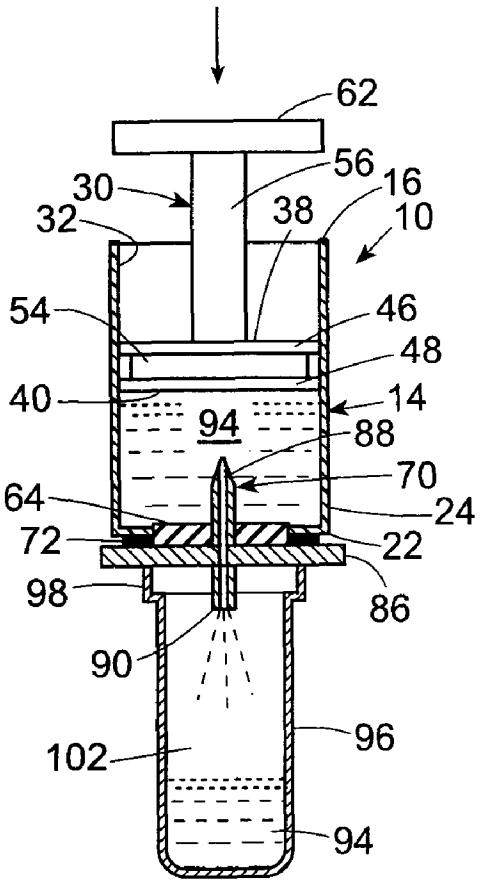
FIGS. 4-6 are views similar to FIG. 3 showing the relative movement and positioning of the reagent cartridge components and the cuvette during fluid transfer from the reagent cartridge to the cuvette; and, FIG. 7 is a simplified perspective view of another embodiment of the invention.

When the septum 64 is punctured by the puncturing end 88 of the hypodermic needle 70, as shown in FIG. 4, reagent 94 can be transferred from the vessel 14 to the cuvette 96 in a predetermined precise quantity that corresponds to the downward stroke length of the piston 30 relative to the vessel 14 (FIG. 5). A precisely measured predetermined amount of reagent can thus be transferred from the vessel 14 to the cuvette 96 via the hypodermic needle 70.

When movement of the piston 30 relative to the vessel 14 ceases, further transfer of reagent 94 from the vessel 14 through the hypodermic needle 70 also ceases.

After the fluid transfer to the cuvette 96 is completed the reagent cartridge 10 and piston 30 are collectively moved with the support flange 86 and the hypodermic needle 70 away from the cuvette 96 as shown in FIG. 6. The puncturing end 88 of the hypodermic needle 70 is retracted from the septum 64 by a resilient expansion force of the neck-like member 72. Alternatively an external retract mechanism (not shown) can be provided to engage the flange 86 in any suitable known manner to retract the needle 70 from the septum 64.

Under this arrangement a desired amount of predetermined precisely measured reagent 94 can be transferred to the cuvette 96 based upon a predetermined downward movement of the piston 30, preferably by a stepper motor (not shown).

Reagent transfer can also be accomplished without causing the flange 86 to engage the upper end 98 of the cuvette 96. Accordingly, the flange 86 is held in a fixed position, spaced slightly above the upper end 98 of the aligned cuvette 96, by any suitable known holding device (not shown). The lower end 90 of the hypodermic needle 70 can thus be positioned at the mouth of the inside space 102 of the aligned cuvette 96, or the lower end 90 can be positioned slightly above the mouth of the inside space 102 but directed into the inside space 102 of the aligned cuvette 96.

The vessel 14 of the reagent cartridge 10 is then moved downwardly toward the cuvette 96 to cause the septum 64 to be punctured by the hypodermic needle 70, which is held fixed by virtue of the flange 86 being held fixed. Reagent transfer from the vessel 14 is then accomplished by descending the piston 30 in the manner previously described.

Since separate aspiration/dispense probes are not required for reagent delivery, the reagent cartridge 10 is a self-contained reagent delivery system. Carryover is eliminated due to the integration of the reagent cartridge 10 and the hypodermic needle 70.

Another advantage of the invention is that the reagent cartridge 10 is essentially hermetically sealed during all reagent transfer operations because there is no air space or headspace in the vessel 14 between the compression surface 40 of the piston 30 and the reagent 94. By virtue of the reagent not being exposed to carbon dioxide, oxygen or other undesirable components within the outside air, the on system life of the reagent 94 is extended, as compared to the on system life of reagent in conventional packaging. Another added benefit of the reagent cartridge 10 is that it eliminates evaporation of the reagent in the vessel 14 during on system storage.

A further advantage of the invention is that there is no foaming of the reagent 94 during transfer of reagent because there is no air-liquid interface at the liquid transfer end 22 of the vessel 14. A still further advantage is that viscous reagents as well as non-viscous reagents are easily transferred to a reagent cuvette in precise predetermined quantities. Still another advantage of the invention is that the reagent cartridge 10 is usable with a plurality of different cuvettes 96 without carryover.

In some instances it may be desirable, after reagent transfer is completed, and before the reagent cartridge 10 is moved away from the cuvette 96 to retract the piston member 30 a small predetermined distance in the vessel 14 to remove any remaining reagent 94 in the hypodermic needle 70.

Figure 7:
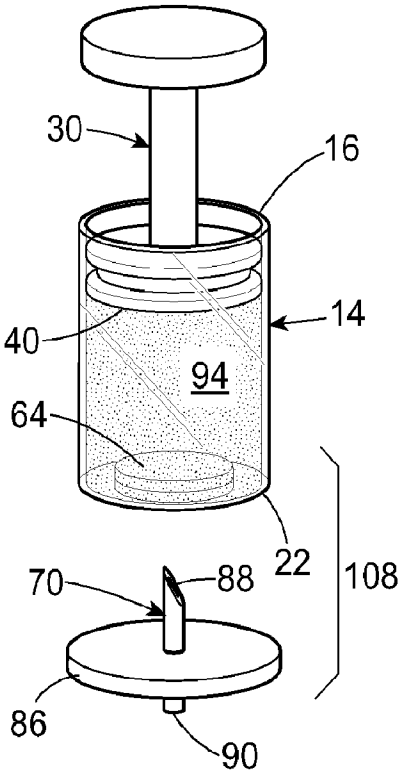

A reagent cartridge incorporating another embodiment of the invention is generally indicated by the reference number 108 in FIG. 7. The reagent cartridge 108 differs from the reagent cartridge 10 in that the neck-like member 72 is eliminated. The reagent cartridge 108 is otherwise identical to the reagent cartridge 10.

In using the reagent cartridge 108, a cuvette 96 and a flange 86 with the hypodermic needle 70 can be moved relative to one another to an alignment position preparatory to reagent transfer in a manner similar to that previously described for the reagent cartridge 10.

For example, the flange 86 and hypodermic needle 70 of the reagent cartridge 108 can be held in a floating position aligned beneath the vessel 14 until a cuvette 96 is aligned with both the hypodermic needle and the reagent cartridge 108.

Any suitable known external raising and lowering mechanism or flange movement mechanism (not shown) can be used to lower the flange 86 onto the upper end 98 of the cuvette 96, or the raising and lowering mechanism can be arranged to position the flange 86 in a location that is spaced slightly above the cuvette 96 prior to fluid transfer. The vessel 14 of the reagent cartridge 108 can then be moved downwardly with the piston 30 to enable the septum 64 of the reagent cartridge 108 to engage the puncturing end 88 of the hypodermic needle 70. The piston 30 is then moved a predetermined amount to complete a desired transfer of the reagent 94 to the cuvette 96. After reagent transfer is completed an external flange movement mechanism (not shown) can hold the flange 86 while the reagent cartridge 108 moves upwardly and away from the hypodermic needle 70 to permit disengagement of the needle puncturing end 88 from the septum 64.

The flange 86 and the hypodermic needle 70 can be reused with another cuvette or the flange 86 and the needle 70 can be disposed of and replaced as desired.

As various changes can be made in the above constructions and methods without departing from the scope of the invention it is intended that all matter contained in the above description or shown in the accompanying drawings shall be interpreted as illustrative and not in a limiting sense.

What is claimed is:

1. A self dispensing reagent cartridge compromising a vessel having an inner wall surface with opposite end portions, (a) one end portion of the vessel accommodating a movable piston having a compression surface, (b) a puncturable septum at the opposite end portion of the vessel, (c) a vessel space of variable volume defined by the inner wall surface of the vessel between the septum and the position of the compression surface of the piston relative to the puncturable septum, the vessel space containing a reagent;

(d) a hollow needle member on a rigid needle support flange, the needle support flange positioned between the puncturable septum of the vessel and a cuvette, the needle support engageable to an upper end of the cuvette, and said needle member having a septum puncturing end that is normally spaced from and directed towards the puncturable septum and a blunt outlet end aligned with an inside space of the cuvette, wherein the needle support flange extends radially outward from a portion of the needle member between the septum puncturing end and the blunt outlet end, wherein the hollow needle member is operational to transfer the reagent from the vessel to the cuvette, (e) said vessel and said needle member with support being relatively movable toward each other to locate the septum puncturing end of said needle member in a septum puncturing position, to enable a predetermined amount of the reagent in the vessel space to be transferred outwardly of the vessel though the hollow needle member, corresponding to a change of position of the compression surface of the piston relative to the septum after the septum puncturing end of said needle is located in the septum puncturing position and, (f) said vessel and needle member with needle support flange being relatively movable away from each other to withdraw the puncturing end of the needle from the septum puncturing position to enable the septum to self seal.

2. The reagent cartridge as claimed in claim 1 wherein the movable piston and the vessel are relatively movable in selected directions to reduce or expand the volume of the vessel space.

3. The reagent cartridge as claimed in claim 2 wherein the movable piston is movable toward and away from the septum.

4. The reagent cartridge as claimed in claim 1 wherein the vessel is movable toward and away from the septum puncturing end of the needle.

5. The reagent cartridge as claimed in claim 1 wherein the movable piston and the vessel are collectively movable in first and second opposite directions.

6. The reagent cartridge as claimed in claim 1 wherein a flexible, collapsible, hollow, neck-like member with opposite ends has one end secured in leak-tight relationship to the needle support flange, and an opposite end secured in leak-tight relationship to the vessel.

7. The reagent cartridge as claimed in claim 6 wherein the neck-like member is in the form of a bellows.

8. The reagent cartridge as claimed in claim 6 wherein the neck-like member has a normally expanded position wherein the needle support flange is at a first predetermined distance from the septum, and the needle puncturing end is at second predetermined distance from the septum and is confined in the neck-like member between the septum and the needle support flange.

9. The reagent cartridge as claimed in claim 6 wherein the needle support flange is movable to a first stop position against one of the vessel, the septum and the collapsed neck-like member, when the puncturing end of the needle is in the septum puncturing position.

10. A self dispensing reagent cartridge; comprising:

a vessel having an inner wall surface with an upper end and a lower end, the upper end accommodating a movable piston head having a piston rod joined to an engagement disc;

a puncturable septum at the lower end of the vessel;

a vessel space of variable volume defined by the inner wall surface between the puncturable septum and the piston, the vessel space containing reagent;

a collapsible member joined to the lower end of the vessel and operational to form a seal around the lower end of the vessel; and a hollow needle member on a needle support flange, the needle support flange engageable at one end to the collapsible member, and engageable at an opposite end to a mouth of a cuvette, the hollow needle member having a septum puncturing end that is normally spaced from and directed towards the puncturable septum and a blunt outlet end directed into an inside space of the cuvette, wherein the needle support flange extends radially outward from a portion of the needle member between the septum puncturing end and the blunt outlet end, and wherein the hollow needle member is operational to transfer the reagent from the vessel space into the cuvette.

* * * * *